US005228673A

United States Patent [19]

Osonoe

[11] Patent Number: 5,228,673

[45] Date of Patent: Jul. 20, 1993

[54] PAPER FEEDING DEVICE HAVING A DRAWER-TYPE CASSETTE AND AN IMAGE FORMING APPARATUS PROVIDED WITH THE PAPER FEEDING DEVICE

[75] Inventor: Yasushi Osonoe, Tokyo, Japan

[73] Assignee: Kabushiki Kaisha Toshiba, Kawasaki, Japan

[21] Appl. No.: 849,958

[22] Filed: Mar. 12, 1992

[30] Foreign Application Priority Data

Apr. 8, 1991 [JP] Japan ..... 3-075210

[51] Int. Cl.[5] ..... B65H 5/00

[52] U.S. Cl. ..... 271/10; 271/110; 271/121; 271/127; 271/146; 271/153; 271/164; 271/167

[58] Field of Search ..... 271/10, 110, 117, 121, 271/126, 127, 146, 153, 167, 105, 210, 213, 902, 163, 164

[56] References Cited

U.S. PATENT DOCUMENTS 3,627,312 12/1971 Fackler et al. .
4,319,741 3/1982 Okamoto ..... 271/162 X
4,488,718 12/1984 Tamura ..... 271/162 X
4,516,764 5/1985 Tamura ..... 271/162 X

FOREIGN PATENT DOCUMENTS 0151560 9/1982 Japan ..... 271/210
0047238 2/1988 Japan ..... 271/162
0221039 9/1990 Japan ..... 271/162
2126993A 4/1984 United Kingdom .

OTHER PUBLICATIONS

Patent Abstracts of Japan, vol. 9, No. 239 (P-391) (1962), Sep. 25, 1985 & JP-A-60 093 465 (Hitachi).
Patent Abstracts of Japan, vol. 12, No. 484 (M-776), Dec. 16, 1988 & JP-A-63 202 523 (Minolta Camera).

*Primary Examiner*—H. Grant Skaggs
*Assistant Examiner*—Carol Lynn Druzbick
*Attorney, Agent, or Firm*—Limbach & Limbach

[57] ABSTRACT

An opening is formed in the bottom portion of a paper cassette, and a rockable elevator is opposed to the opening. The elevator is rocked by an elevator operating mechanism, thereby pushing up a tray so that paper sheets in the paper cassette reach a position suited for takeout, or getting out of the cassette. The elevator is continuously moved up and down a plurality of times by means of the elevator operating mechanism after the end of paper feeding operation, whereby the takeout end portions of a second one of the paper sheets P and its subsequent ones, which project from the paper cassette as the sheets are taken out by a takeout mechanism, are vertically oscillated so that those sheets are repeatedly curved and straightened. As a result, the paper sheets projecting from the paper cassette are automatically returned to the cassette by their own elasticity.

8 Claims, 10 Drawing Sheets

PAPER FEEDING DEVICE HAVING A DRAWER-TYPE CASSETTE AND AN IMAGE FORMING APPARATUS PROVIDED WITH THE PAPER FEEDING DEVICE

BACKGROUND OF THE INVENTION

1. Field of the Invention

The present invention relates to a paper feeding device used in an office automation apparatus, such as an electronic copying machine, and an image forming apparatus provided with the paper feeding device, and more particularly, to a paper feeding device having a drawer-type paper cassette, which can be loaded into and unloaded from a cassette holding section, and an image forming apparatus provided with the paper feeding device.

2. Description of the Related Art

In general, paper feeding devices having a drawer-type paper cassette are designed so that paper sheets in the paper cassette are pushed up to a takeout position in a state ready for paper feed such that the cassette is securely held in a cassette holding section. In loading or unloading the paper cassette, a tray is released from a lifted state lest the paper sheets hinder the operation.

According to a conventional paper feeding device of this type disclosed in Published Unexamined Japanese Patent Application No. 2-233425, however, paper sheets in a paper cassette are kept up to be on standby without regard to the operation mode, and a tray is lowered when the cassette is to be loaded or unloaded.

Accordingly, if any subsequent paper sheets project from the paper cassette as a preceding paper sheet is taken out, that is, in case of "stay of paper at the delivery port," the projecting sheets sometimes fail to be restored to their regular position in the cassette even when the tray is lowered. This phenomenon frequently occurs when the residual quantity of the paper sheets in the cassette is small.

Thus, in the conventional paper feeding device, the paper sheets having once projected from the delivery port cannot be returned to their regular position in the paper cassette. As the cassette is drawn out, therefore, the projecting sheets are caught and damaged by the rear-side open edge portion of a cassette loading aperture. Removal of these damaged sheets is troublesome and uneconomical.

SUMMARY OF THE INVENTION

The present invention has been contrived in consideration of these circumstances, and its object is to provide a paper feeding device and an image forming apparatus with the paper feeding device, in which a paper sheet projecting from a paper cassette can be automatically returned to the cassette after the end of paper feeding operation, so that paper sheets cannot be damaged as the cassette is drawn out.

A paper feeding device comprises:

a paper cassette in which paper sheets are stored, the paper cassette being removably mountable in first direction to the paper feeding device, the paper cassette including a cassette casing and a tray for supporting the paper sheets thereon, the tray, being supported by the cassette casing and rockable in a predetermined direction such that the paper sheets move up and down;

means for moving the tray in the predetermined direction;

takeout means for taking out the paper sheets from the paper cassette one by one in second direction while the moving means moves up the tray, the second direction being generally perpendicular to the first direction;

means for receiving the paper sheets taken out by the takeout means, the receiving means including means for preventing the receiving means from receiving an extra paper sheet when the takeout means provides the extra paper sheet; and means for controlling the rocking operation of the moving means so that the paper sheets in the paper cassette continuously move up and down a plurality of times after the end of paper feeding operation by the takeout means to return the extra paper sheet for the tray.

According to the paper feeding device of the invention, the tray, bearing the paper sheets thereon, is moved up and down a plurality of times after the end of the paper feeding operation. Accordingly, a paper sheet which projects from the paper cassette is repeatedly curved and straightened, and is returned to its regular position in the cassette by its own elasticity. In this manner, the paper sheets can be securely prevented from being caught and damaged by the rear-side open edge portion of a cassette loading aperture as the paper cassette is drawn out.

According to an image forming apparatus provided with the paper feeding device described above, the takeout of the paper sheets cannot be started with any sheet projecting from the paper cassette, so that faulty paper transportation can be prevented to ensure reliable image formation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of the present invention will now be described with reference to the accompanying drawings.

Figure 1:
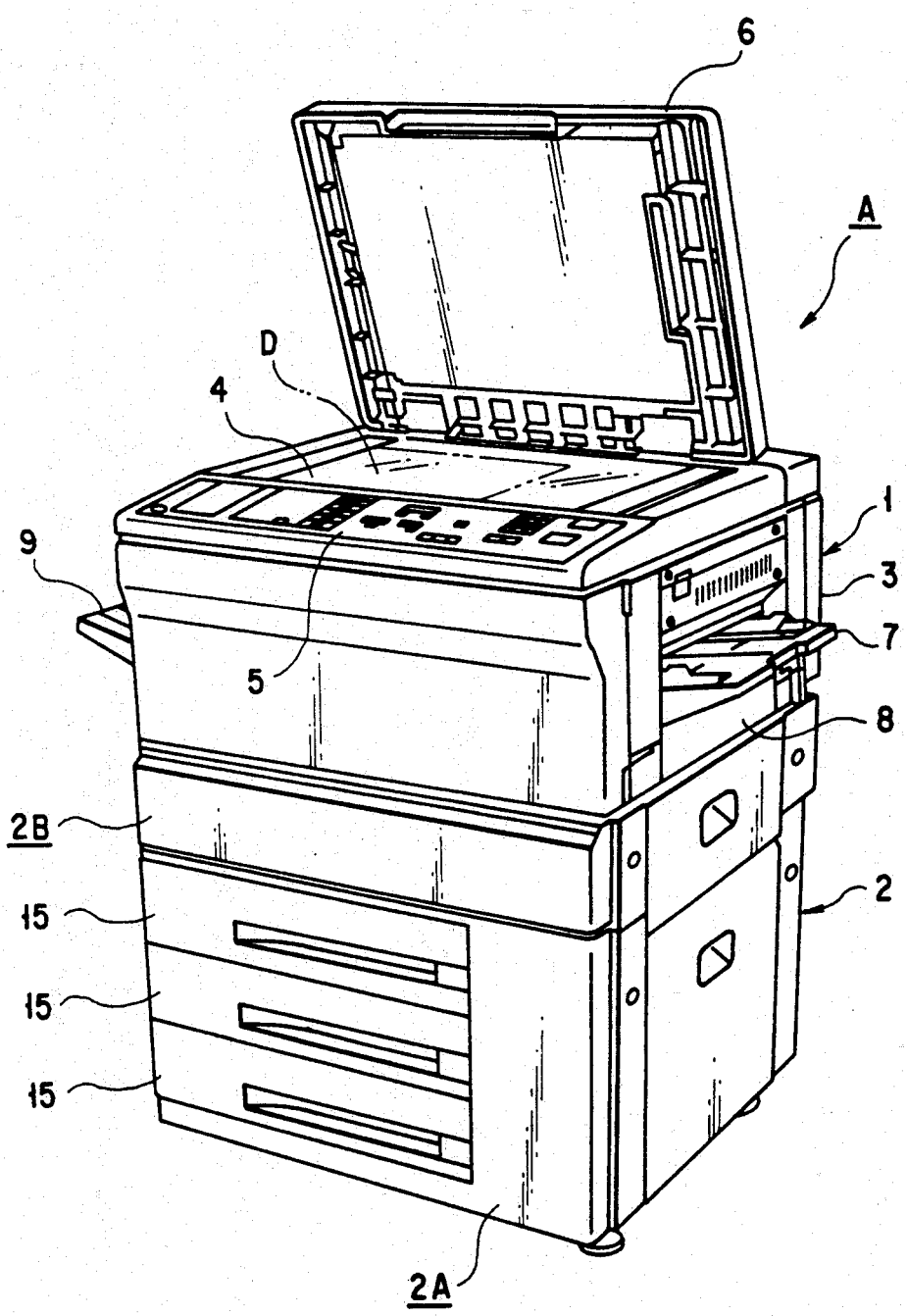
FIG. 1 is a perspective exterior view of an image forming apparatus unit using a paper feeding device according to the present invention.
Figure 2:
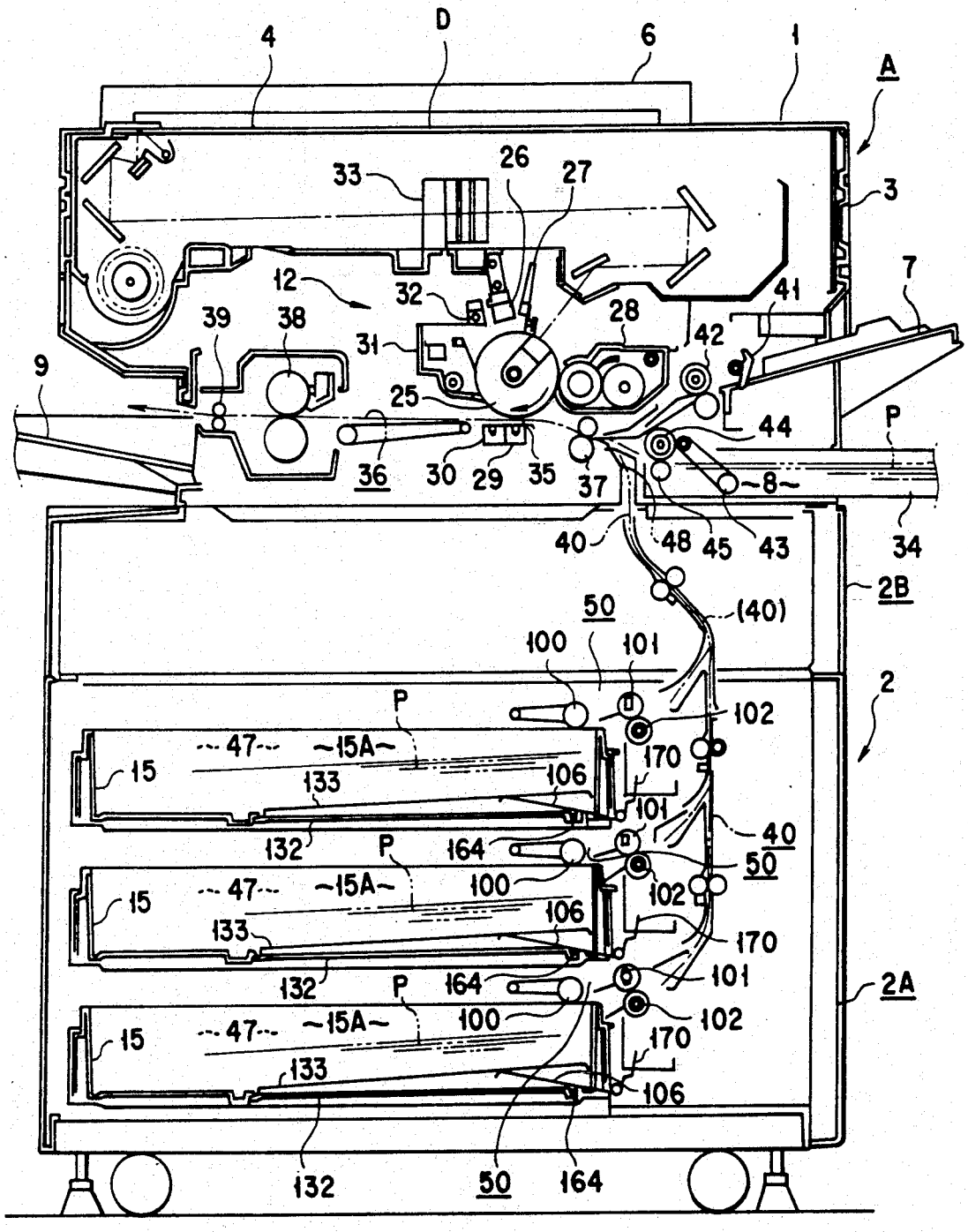
FIG. 2 is a schematic view showing the internal structure of the image forming apparatus unit shown in FIG. 1.

FIG. 1 shows an external appearance of an image forming apparatus unit A, which comprises an electrophotographic copying apparatus 1, for use as an image forming apparatus according to the present invention, and a multi-cassette feeder 2 as a paper feeding device. FIG. 2 schematically shows the internal structure of the image forming apparatus unit A.

The electrophotographic copying apparatus 1 is constructed as follows. An original glass 4 for use as an original table is disposed on the top side of an apparatus body 3, and an operator panel 5 is arranged along the front edge portion of the body 3. An original holding cover 6 is swingably attached to the rear edge portion of the top face of the apparatus body 3. The cover 6 serves to hold down an original D on the original glass 4.

A sheet-bypass guide 7 and a cassette loading section 8 are arranged on the right-hand side face of the apparatus body 3. The loading section 8, which is situated below the guide 7, is designed for the loading of an optional paper cassette. A copy receiving tray 9 is attached to the left-hand side face of the body 3.

Image forming means 12 is contained in the apparatus body 3.

The image forming means 12 is constructed as follows. As shown in FIG. 2, a rotatable photoreceptor drum 25, for use as an image carrying body, is situated substantially in the center of the apparatus body 3.

A charger 26 and an LED eraser array 27 are arranged around the photoreceptor drum 25 along the rotating direction (indicated by the arrow) thereof. The charger 26 is used to uniformly charge the surface of the drum 25. The array 27 forms an image forming region, as required, by applying a light beam to a region charged by means of the charger 26, to remove electric charge from the charged region.

Following the LED eraser array 27, moreover, a developing unit 28, transfer unit 29, separation unit 30, cleaning unit 31, and discharge unit 32 are successively arranged in the rotating direction of the photoreceptor drum 25. The developing unit 28 forms a developer image by applying a developing agent to an electrostatic latent image formed on the drum 25 by means of an exposure unit 33 (mentioned later). The transfer unit 29 transfers the developer image on the drum 25 to a paper sheet P. The separation unit 30 is used to separate the sheet P, having the developer image thereon, from the drum 25. In the cleaning unit 31, the developing agent remaining on the drum 25 after the transfer of the developer image is scraped off by means of a blade and recovered. The discharge unit 32 removes a residual charge image by applying a light beam to the photoreceptor drum 25.

Further, the exposure unit 33 of a moving optical system type is disposed in the top portion of the apparatus body 3. It serves to expose that region of the photoreceptor drum 25 between the LED eraser array 27 and the developing unit 28 to image information of the original D on the original glass 4, for scanning.

Also, a paper transportation path 36 is formed in the apparatus body 3. It is used to guide the paper sheet P, automatically fed from the multi-cassette feeder 2 or a paper cassette 34 attached to the cassette loading section 8, or manually fed from the sheet-bypass guide 7, to the copy receiving tray 9 via an image transfer section 35 between the transfer unit 29 and the photoreceptor drum 25.

An aligning roller pair 37, as aligning means for correcting a skew of the paper sheet P, is situated on the upper-course side of the paper transportation path 36 with respect to the image transfer section 35. On the lower-course side of the path 36 with respect to the transfer section 35, more over, a fixing unit 38 and an exit roller pair 39 are arranged in succession. The fixing unit 38 is used to fix the transferred developer image on the sheet P. The exit roller pair 37 serves to discharge the fixed sheet onto the copy receiving tray 9.

A lower-course end 40A of a paper-feed transportation path 40 joins that portion of the paper transportation path 36 on the upper-course side with respect to the aligning roller pair 37. The path 40 is used to transport the paper sheet P fed from the multi-cassette feeder 2.

A paper detection switch 41 and a sheet-bypass roller 42 are arranged between the sheet-bypass guide 7 and the aligning roller pair 37. Further, a pickup roller 43, paper-supply roller 44, separation roller 45, etc. are arranged corresponding to the cassette loading section 8. The pickup roller 43 is used to take out paper sheets P from the paper cassette 34 which is set in the cassette loading section 8. The paper-supply roller 44 transports each paper sheet P, taken out by means of the pickup roller 43, so that the sheet P is fed into the paper-feed transportation path 40. The separation roller 45 serves to separate subsequent paper sheets P from the sheet P to be transported by means of the roller 44 lest the sheets be taken out together.

A detailed description of the image forming operation of the electrophotographic copying apparatus 1 thus constructed is omitted herein, since the operation has no direct relation to the present invention.

The following is a description of an arrangement of the multi-cassette feeder 2 for use as the paper feeding device.

First, the basic configuration of the feeder 2 will be described.

The multi-cassette feeder 2 comprises a lower unit 2A and an upper unit 2B.

The lower unit 2A, which is formed having three cassette holding sections 47, upper, middle, and lower, contains three detachable paper cassettes 15.

Paper storage sections 15A of the lower, middle, and upper paper cassettes 15 can be stored with paper sheets P of sizes A4, B4, and A3, respectively, for example.

The paper-feed transportation path 40 is formed extending through the respective right-hand side regions of the lower and upper units 2A and 2B. The paper sheet P, alternatively taken out from any of the paper cassettes 15 by its corresponding paper feeding means 50, is transported upward or toward the electrophotographic copying apparatus 1 along the path 40.

The paper sheet P is taken out in a direction (to the right as in the state of FIG. 2) perpendicular to the direction (depth direction as in the state of FIG. 2) along which the paper cassettes 15 are loaded into and unloaded from the cassette holding sections 47.

A terminal end portion 40A of the paper-feed transportation path 40 is connected to a paper inlet path 48, which joins the upper-course side of the paper transportation path 36 in the electrophotographic copying apparatus 1.

Figure 3:
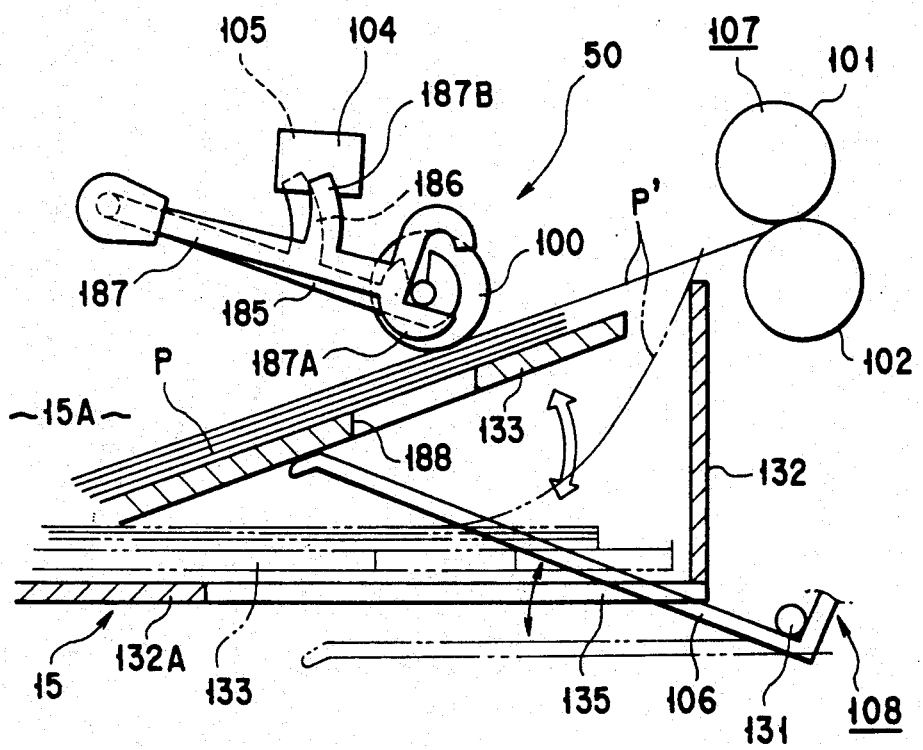
FIG. 3 is a schematic view showing the principal part of the paper feeding device of the invention in a state after the end of paper feeding operation.

As shown in FIG. 3, moreover, the paper feeding means 50 is disposed in the vicinity of the location of each paper cassette 15. It serves to feed the paper sheets P in the paper storage section 15A one by one into the paper-feed transportation path 40.

The paper feeding means 50 includes a pickup roller 100 and delivery means 107. The pickup roller 100 serves as takeout means for picking up the uppermost one of the paper sheets P stored in the paper storage section 15A. The delivery means 107 delivers the paper sheets P, taken out by means of the roller 100, one after another. It includes a feed roller 101 for taking out each paper sheet P and a separation roller 102, which prevents subsequent paper sheets P from being taken out jointly with the sheet P being taken out by means of the feed roller 101.

A feed clutch (not shown), a tray-up switch 104, and an empty switch 105 are arranged in the vicinity of the paper feeding means 50. The feed clutch serves to allow or prevent transmission of a driving force to the rollers 100, 101 and 102. The tray-up switch 104 is used to detect the location of a tray 133, which bears the paper sheets P thereon, in its up position. The empty switch 105 detects the absence of the paper sheets P.

Tray lift means 108 for pushing up the paper tray 133 is disposed in the vicinity of the paper takeout side of each paper cassette 15.

The tray lift means 108 comprises an elevator 106 for use as a lift member, which is rockable around a shaft 131 so that its free end portion can engage the lower surface of the tray 133, and an elevator operating mechanism 130 for rocking the elevator 106 around the shaft 131, thereby pushing up the tray 133 so that each paper sheet P reaches a position suited for takeout.

An opening 135 for elevator setting is formed in a bottom portion 132A of a casing 132 of each paper cassette 15. The elevator 106 can be freely inserted into and removed from the casing 132 through the opening 135.

Figure 4:
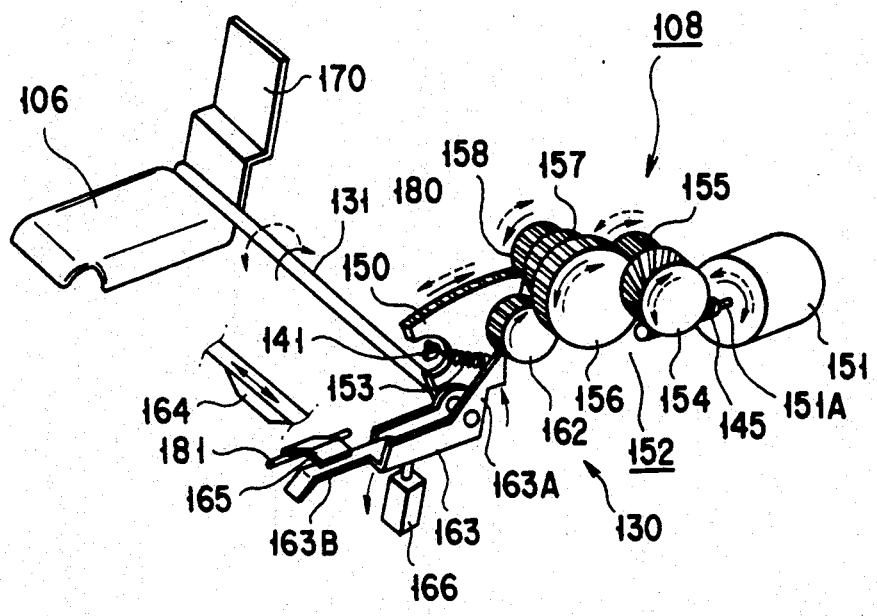
FIG. 4 shows an arrangement of tray lift means constituting the principal part of the paper feeding device of the invention.
Figure 5:
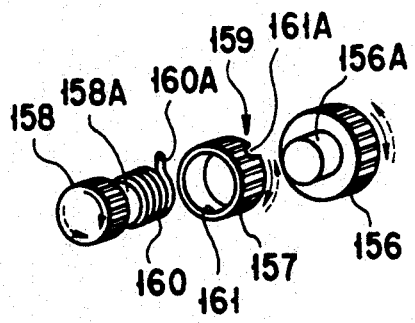
FIG. 5 is an exploded perspective view showing part of a gear group shown in FIG. 4.
Figure 6:
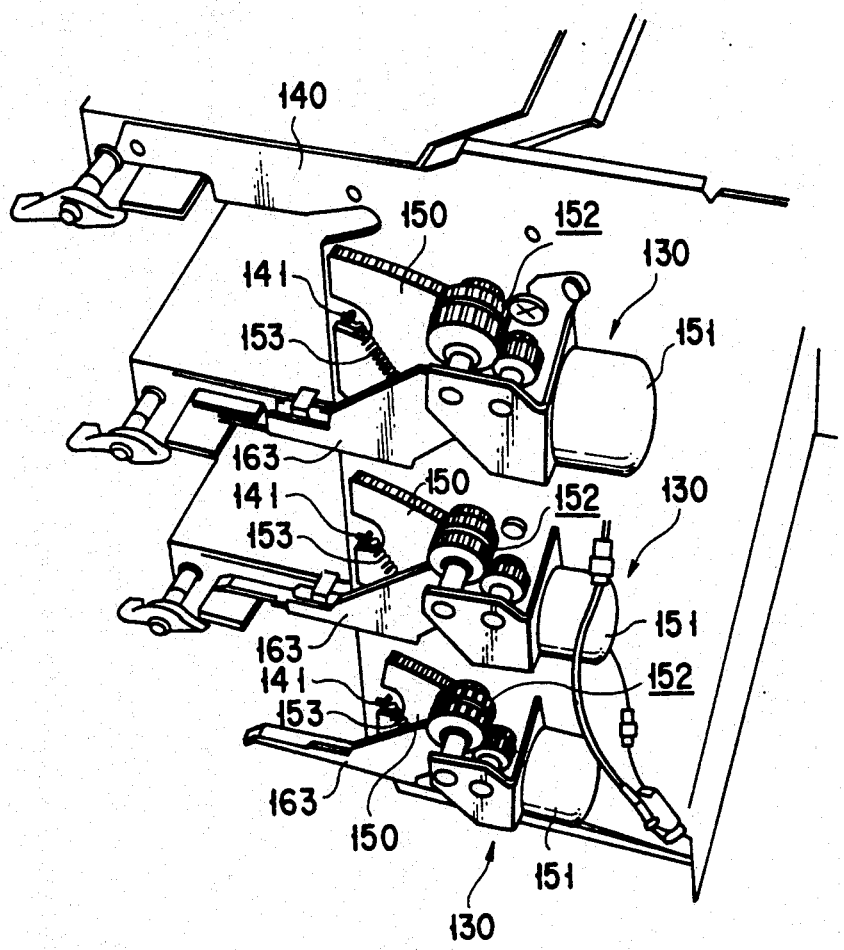
FIG. 6 is a schematic perspective view showing an arrangement of the principal part of the tray lift means shown in FIG. 4.

Referring now to FIGS. 4 to 6, the elevator operating mechanism 130 for each tray lift means 108 for pushing up the tray 133 of each paper cassette 15 will be described.

Since the elevator operating mechanisms 130 for the individual paper cassettes 15 have the same construction, only that for the lower cassette 15 will be described.

The elevator 106 for pushing up the tray 133 is fixedly mounted on the shaft 131 which is rockably supported by bearing means (not shown). The shaft 131 is mounted so that its axial direction is in line with the cassette loading direction. A sector wheel 150, for use as a toothed rocking member, is mounted on the front-side end of the shaft 131. One end of a tension spring 153, for use as an urging member, is anchored to a spring peg member 141 which protrudes from a frontside frame 140 (see FIG. 6). The other end of the spring 153 is anchored to the wheel 150 so that the spring continually urges the wheel to lower the elevator 106.

The driving force of a tray motor 151, for use as a drive source, is transmitted to the sector wheel 150 by means of a gear group 152. As the motor 151 is driven in the direction of the full-line arrow of FIG. 4, the elevator 106 is rocked around the shaft 131 to ascend against the urging force of the spring 153.

The gear group 152 has a spring clutch mechanism 159 built-in. As shown in the exploded view of FIG. 5, a coil spring 160 is contained in the bore portion of a sleeve 161, which has a gear 157 on its outer peripheral surface. The gear 157 constitutes part of the gear group 152. The bore portion of the spring 160 is fitted on a boss portion 156A, which is integral with its adjacent gear 156, and a boss portion 158A, which is integral with a gear 158. One end portion 160A of the coil spring 160 is bent to project outward, and is in engagement with a notch portion 161A of the sleeve 161.

The following is a description of the operation of the elevator operating mechanism 130 constructed in this manner.

When the tray 133 ascends, a drive shaft 151A of the tray motor 151 rotates in the direction of the full-line arrow of FIG. 4, and a worm wheel 154, which is in mesh with a worm 145 integral with the shaft 151A, and a gear 155 integral with the wheel 154 rotate in the direction of the full-line arrows.

As the gear 155 rotates in this manner, the gear 156 integral therewith rotates in the direction of the full-line arrow, so that the coil spring 160 of the spring clutch mechanism 159 is tightened, that is, the driving force is allowed to be transmitted, and the gears 157 and 158 rotate in the same direction. Thereupon, the sector wheel 150 in mesh with the gear 158 is rocked in the direction of the full-line arrow, resisting the urging force of the tension spring 153.

As a result, the shaft 131, which is integral with the sector wheel 150, rocks in the direction of the full-line arrow, and the elevator 106, which is integral with the shaft 131, is rocked to a position where it pushes up the tray 133, as indicated by the full line in FIG. 3.

When the tray 133 descends, the drive shaft 151A of the tray motor 151 rotates in the direction of the broken-line arrow of FIG. 4, and the worm wheel 154, which is in mesh with the worm 145 integral with the shaft 151A, and the gear 155 integral with the wheel 154 rotate in the direction of the broken-line arrows.

As the gear 155 rotates in this manner, the gear 156 integral therewith rotates in the direction of the broken-line arrow, so that the coil spring 160 of the spring clutch mechanism 159 is loosened, that is, the driving force can be prevented from being transmitted, and the gear 158 is set free.

When the gear 158 is set free, the sector wheel 150 is rocked in the direction of the broken-line arrow by the urging force of the tension spring 153.

As a result, the shaft 131, which is integral with the sector wheel 150, rocks in the direction of the broken-line arrow, and the elevator 106, which is integral with the shaft 131, is rocked to a position where the tray 133 is released from the lifting action, as indicated by the two-dot chain line in FIG. 3.

The elevator 106 can be lowered to the tray release position by some other drive means than the tray motor 151. More specifically, this can be achieved by in association with the cassette drawing operation or by operating a switch (not shown) to activate a tray-down solenoid 166, which will be mentioned later.

The following is a description of an arrangement for the operation described above.

An elevator lever 163, for use as a clutch release member, is rockably mounted on the shaft 131. One end piece portion 163A of the lever 163 is formed having a tooth portion 180, which meshes with a gear 162 which is in mesh with the gear 157 formed on the outer peripheral surface of the sleeve 161 of the spring clutch mechanism 159.

The other end piece portion 163B of the elevator lever 163 horizontally extends in the direction perpendicular to the path of transfer of a cassette projection 164, which protrudes from the front portion of the lower surface of the cassette 15. A plate-shape pusher 165 is provided between the transfer path of the projection 164 and the top side of the end piece portion 163B of the lever 163. The pusher 165, which is bent in the middle at an obtuse angle, has its one end portion mounted on a rotatable shaft 181, and is urged by means of a spring member (not shown) so that its free end side is always situated in an elevated position.

When the paper cassette 15 is drawn out by a short distance such that the elevator setting opening 135 of the cassette casing 132 and the elevator 106 do not interfere with each other, the cassette projection 164 abuts against the pusher 165, thereby causing the pusher 165 to rock against the urging force of the spring member (not shown), so that the free end portion of the pusher 165 depresses the other end piece portion 163B of the elevator lever 163.

Thereupon, the elevator lever 163 rocks in the direction of the full-line arrow around the shaft 131, so that the gear 162 rotates in the direction of the full-line arrow. As the gear 162 rotates in this manner, the sleeve 161 of the spring clutch mechanism 159, which has, on its peripheral surface, the gear 157 in mesh with the gear 162, rotates. As the sleeve 161 rotates in this manner, the spring 160 of the mechanism 159 loosens, so that the gear 158 is set free.

When the gear 158 is set free, the sector wheel 150 is rocked in the direction of the broken-line arrow by the urging force of the tension spring 153, as mentioned before.

As a result, the shaft 131, which is integral with the sector wheel 150, rocks in the direction of the broken-line arrow, and the elevator 106, which is integral with the shaft 131, is rocked to the position where the tray 133 is released from the lifting action.

Thereupon, the elevator 106 gets out of the casing 132 of the paper cassette 15, as indicated by the two-dot chain line in FIG. 3, so that the cassette 15 can be drawn out without being caught by the elevator 106.

The tray-down solenoid 166 is connected to the other end piece portion 163B of the elevator lever 163. If necessary, the piece portion 163B of the lever 163 can be rocked downward by operating the switch (not shown) to activate the solenoid 166. Thereafter, the elevator 106 can be lowered to the tray release position in the same manner as in the aforesaid case where this operation is associated with the cassette drawing operation.

When the tray 133 is thus pushed up by means of the elevator 106 in the cassette casing 132, the uppermost one of the paper sheets P on the tray 133 comes into contact with the pickup roller 100. When the elevator 106 gets out of the paper cassette 15 so that the tray 133 extends along the bottom portion 132A of the cassette casing 132, moreover, the uppermost sheet P over the tray 133 is separated from the pickup roller 100.

In association with this action of the elevator 106, the separation roller 102 is brought into contact with or separated from the feed roller 101.

Figure 7:
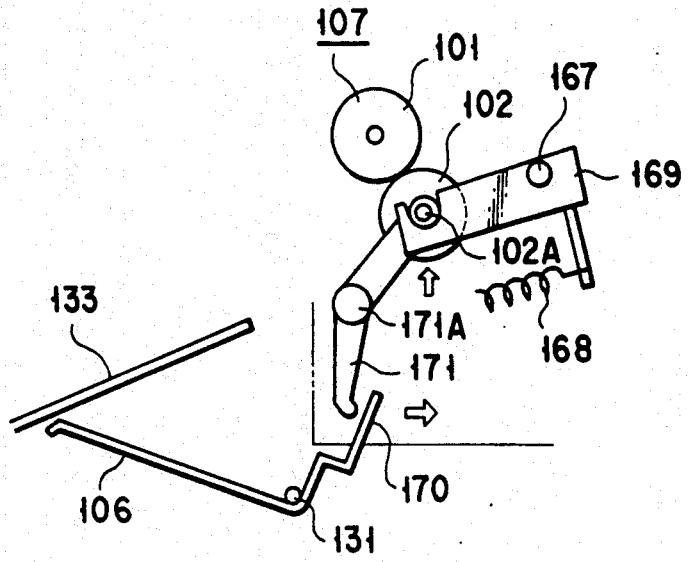
FIG. 7 is a diagram for illustrating a state of a separation roller established when a tray is up.
Figure 8:
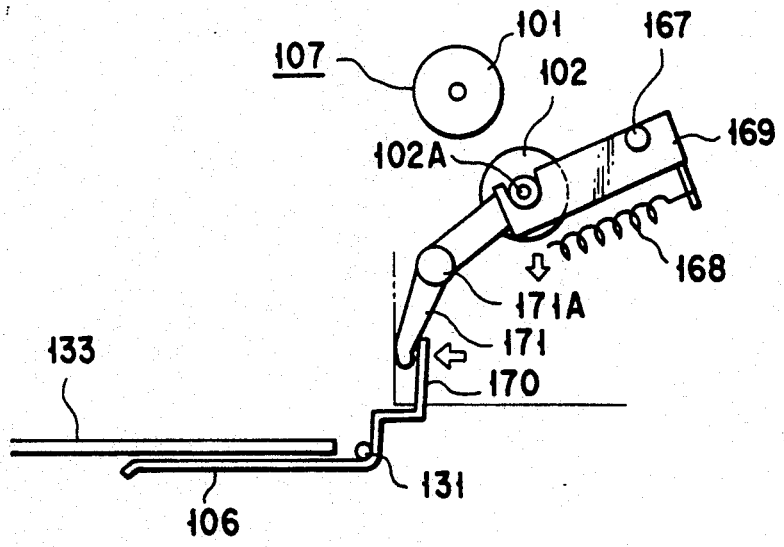
FIG. 8 is a diagram for illustrating a state of the separation roller established when the tray is released.

As shown in FIGS. 7 and 8, an operating lever 170 is formed integrally with the elevator 106. The upper end portion of the lever 170 is opposed to a lever arm 171. The arm 171 is retained so as to be rockable around a pivot 171A formed in the middle portion thereof, and the separation roller 102 is mounted on the upper end side of the arm 171. A shaft 102A of the roller 102 is continually urged to be pushed up by means of a bracket 169, which is urged to rock around a shaft 167 by means of a spring 168 having one end anchored to a spring peg member (not shown).

When the elevator 106 is in its up position (ready for paper supply), as shown in FIG. 7, the upper end portion of the operating lever 170, which is integral with the elevator 106, is off the lever arm 171. Accordingly, the shaft 102A of the separation roller 102 is continually pushed up by the bracket 169 which is urged by means of the spring 168, so that the roller 102 is brought into contact with the feed roller 101.

When the elevator 106 is in its down position (not ready for paper supply), as shown in FIG. 8, the upper end portion of the operating lever 170, which is integral with the elevator 106, presses the lever arm 171, thereby rocking the arm 171 against the urging force of the spring 168. As a result, the separation roller 102 is separated from the feed roller 101.

According to this arrangement, even when the paper cassette 15 is drawn out to remove a jam caused immediately after the start of paper supply, the paper sheet P can be prevented from being damaged, since the leading end of the sheet P is not caught between the feed roller 101 and the separation roller 102. Further, deformation of the rollers 101 and 102, due to the continual pressure contact between them, and lowering of the paper feeding performance, attributable to migration of oil in the rollers, which may be caused if the rollers are formed of materials containing different ingredients, can be prevented.

A cassette latch (not shown), for use as a lock member, is attached to the top-side front edge portion of the paper cassette 15. When the cassette 15 is pushed in to a predetermined position such that it abuts against a stopper (not shown), the cassette latch engages an engaged portion (not shown), whereby the cassette is locked in the predetermined position. Thereupon, a cassette switch (not shown) is activated by the rear end of the cassette 15, and detects the presence of the cassette.

When the set paper cassette 15 is detected, the tray motor 151 is driven to lift the tray 133 of the cassette 15 in the aforesaid manner.

The uppermost one of the paper sheets P on the tray 133 comes into contact with the pickup roller 100, and the roller 100 is then pushed up. When this is detected by means of the tray-up switch 104, which is activated by an actuator 186 attached to a pickup arm 185, the tray motor 151 stops, so that the tray 133 ceases to move. This position is a position for paper feed.

Figure 9:
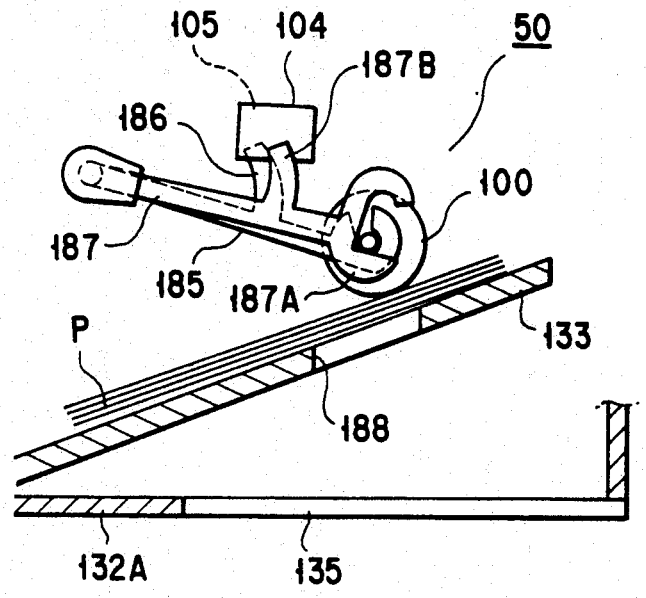
FIG. 9 is a view showing a case in which "PAPER STORED" is detected.

If the paper sheets P are on the tray 133 at this time, a free end portion 187A of an actuator 187 for paper detection is kept over the sheets P, as shown in FIG. 9, so that the presence of the sheets is detected by means of the empty switch 105, which is activated by a switching operating piece portion 187B, and "PAPER STORED" is indicated.

Figure 10:
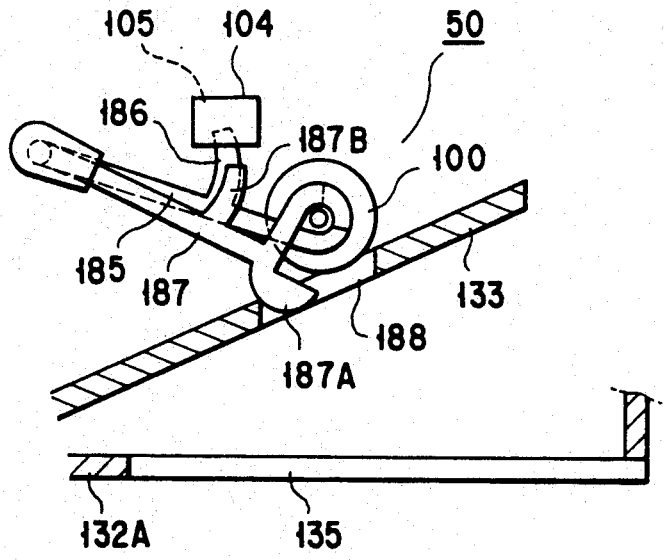
FIG. 10 is a view showing a case in which "NO PAPER" is detected.

If there are no paper sheets P on the tray 133, the free end portion 187A of the actuator 187 for paper detection falls into an opening 188 in the tray 133, as shown in FIG. 10, so that the switch operating piece portion 187B is off the detecting position for the empty switch 105, and "NO PAPER" is indicated.

Figure 11:
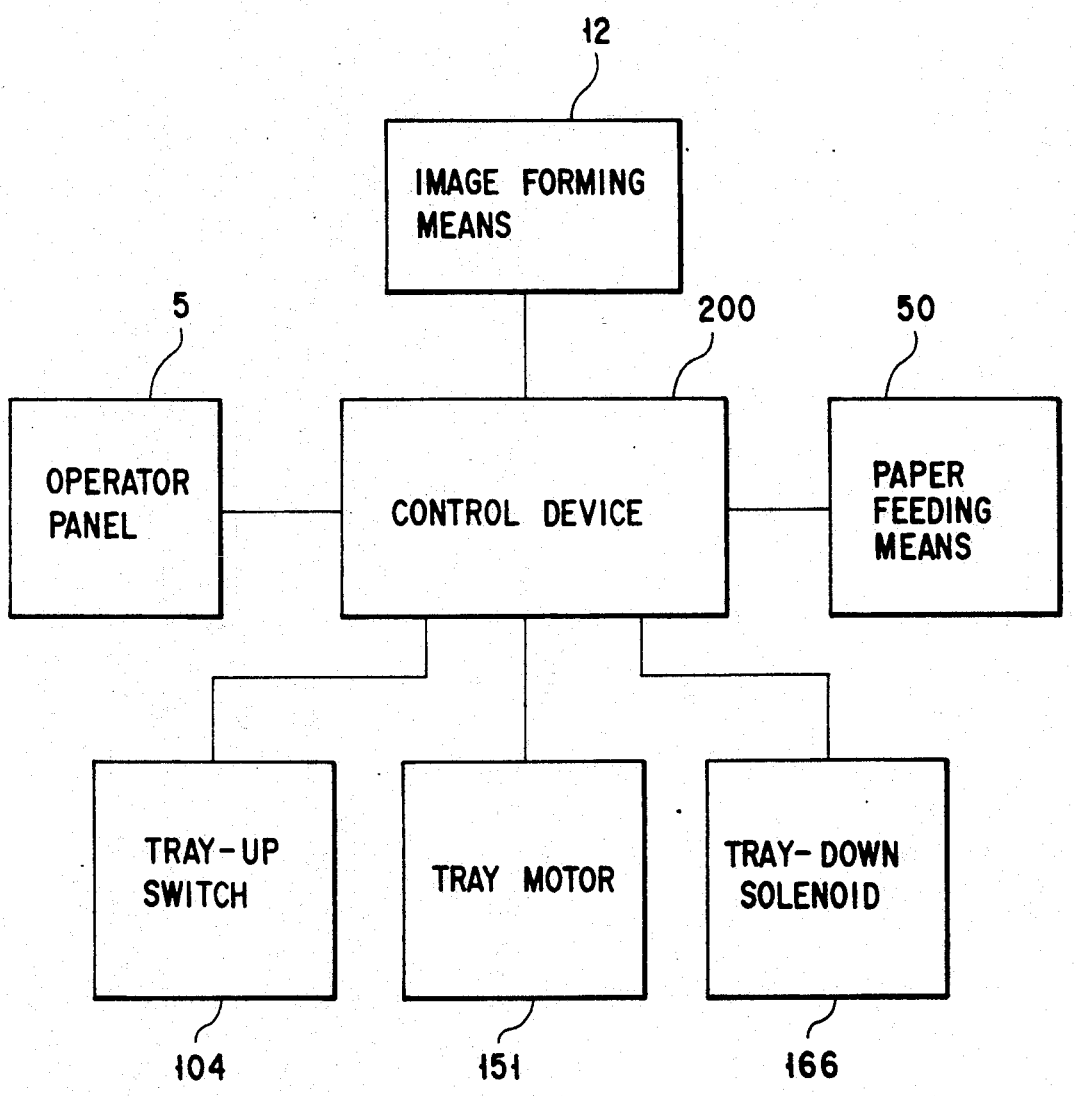
FIG. 11 is a block diagram showing a control system.

As shown in FIG. 11, moreover, the tray motor 151 of the elevator operating mechanism 130, tray-down solenoid 166, and tray-up switch 104 are connected to a control device 200 for use as control means, which is connected with the operator panel 5, image forming means 12, paper feeding means 50, etc.

Figure 12:
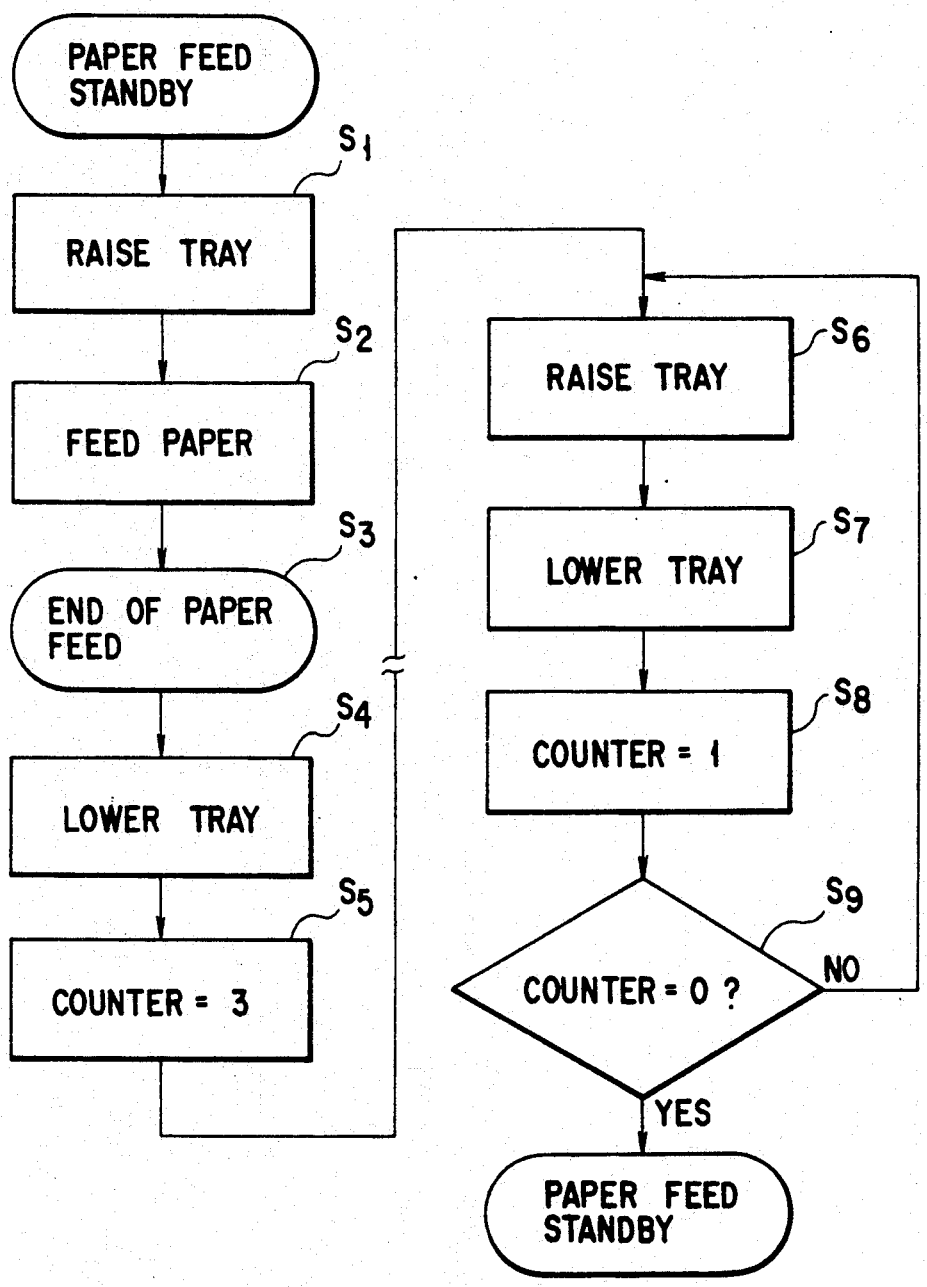
FIG. 12 is a flow chart showing processes of tray operation.

The control device 200 performs the control operation shown in the flow chart of FIG. 12. When a paper feed signal is inputted in a paper feed standby mode, the tray 133 is lifted (Step Sl), and thereafter, the paper sheets are fed (Step S2). When the paper feed is finished (Step S3), the tray 133 is lowered (Step S4). At the same time, a counter is set at "3" (Step S5). Thereafter, the tray 133 is repeatedly raised and lowered (Steps S6 to S8), and the value in the counter is decremented on each occasion so that it finally becomes "0" (Step S9). Thereupon, the paper feed standby mode is established.

As described above, the tray lift means 108 is controlled so that the tray rocking operation is repeated a plurality of times (three times in the embodiment) after the end of the paper feeding operation (or copying operation). Thus, the tray 133 is alternately shifted between a tilted position, indicated by the full line of FIG. 3 and shown in FIG. 13, and a level position, indicated by the two-dot chain line of FIG. 3 and shown in FIG. 14.

During the paper feeding operation, the paper sheets P in the paper cassette 15 are carried by means of the pickup roller 100 to the position where the feed roller 101 and the separation roller 102 are in contact with each other. If several paper sheets P are delivered by means of the pickup roller 100, the uppermost one of them is fed forward by the feed roller 101, while the subsequent ones are returned by the separation roller 102.

Figure 13:
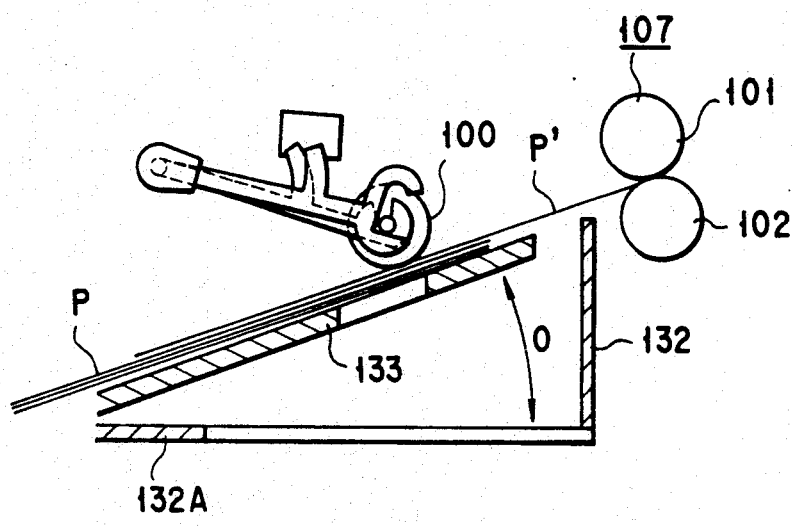
FIG. 13 is a diagram for illustrating a state in which a paper sheet projects from a cassette casing after paper feeding operation.
Figure 14:
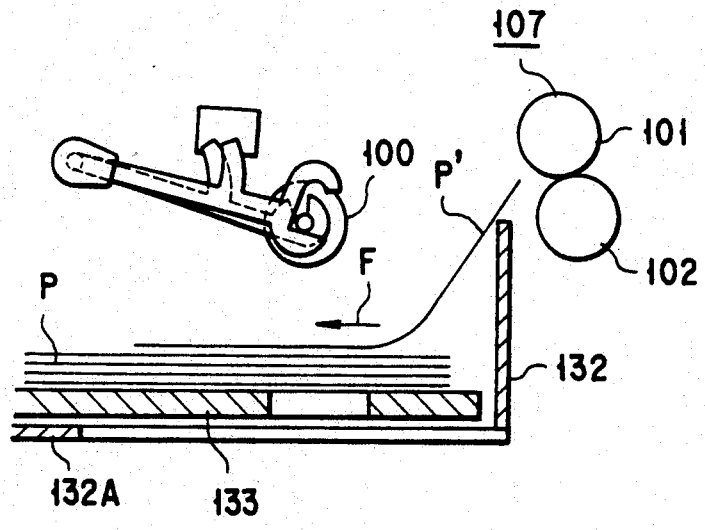
FIG. 14 is a diagram for illustrating the way the paper sheet projecting from the cassette casing is returned.

In this case, however, the subsequent paper sheets P fail to be entirely restored to their regular position in the paper cassette 15, and their leading ends are left between the feed roller 101 and the separation roller 102, as shown in FIG. 13, when the copying ends.

If there are few paper sheets P remaining in the paper storage section 15A, the tray 133 is inclined at an angle $\theta$ of about 13°.

Conventionally, as mentioned before, the paper sheets P in the paper cassette 15 are kept up to be on standby even after the end of the paper feeding operation. In controlling the descent of the tray 133, moreover, the operation is finished once the tray is lowered, and the tray is not repeatedly moved a plurality of times. On rare occasions, therefore, a paper sheet P' projecting from the paper cassette 15 may be caught by the cassette casing 132, as indicated by the two-dot chain line of FIG. 3, thus failing to be restored to the cassette 15, although the tray 133 is lowered.

If the paper cassette 15 is drawn out in this state, that portion of the paper sheet P' which projects from the cassette casing 132 is caught by the rear-side open edge portion of a cassette loading aperture, so that the sheet P' may possibly be damaged.

In the paper feeding device according to the present invention, however, the tray 133, bearing the paper sheets P thereon, are moved up and down a plurality of times after the end of the paper feeding operation. Accordingly, the paper sheet P' projecting from the paper cassette 15 is repeatedly curved and straightened, so that a slip is caused between the sheet P' and a subsequent sheet P by the elasticity of the sheet P' itself. Thus, the sheet P' moves in the manner indicated by arrow F in FIG. 14, and is returned to its regular position in the cassette 15.

In this manner, the paper sheets P can be securely prevented from being caught and damaged by the rear-side open edge portion of the cassette loading aperture as the paper cassette 15 is drawn out.

In the embodiment described above, the tray 133, bearing the paper sheets P thereon, is moved up and down three times. Alternatively, however, the tray 133 may be moved twice or four or more times. What is essential is to securely restore the paper sheet P' which projects from the paper cassette 15, in consideration of the residual quantity of the paper sheets P, the angle of inclination of the tray 133, etc.

According to the arrangement described above, moreover, the paper feeding device of the present invention is applied to the multi-cassette feeder 2 which is attached to the electrophotographic copying apparatus 1 as an image forming apparatus. Alternatively, however, the invention may be applied to a paper feeding device which is incorporated in the electrophotographic copying apparatus 1. The point is that the paper feeding device be provided with the rockable tray 133 which can bear the paper sheets P stored in the bottom portion of the paper storage section 15A, and use the drawer-type paper cassette 15 which can be loaded into and unloaded from the cassette holding section.

It is to be understood that the present invention is not limited to the embodiment described above, and that various changes and modifications may be effected therein by one skilled in the art without departing from the scope or spirit of the invention.

Additional advantages and modifications will readily occur to those skilled in the art. Therefore, the invention in its broader aspects is not limited to the specific details, and representative devices, shown described herein. Accordingly, various modifications may be made without departing from the spirit or scope of the general inventive concept as defined by the appended claims and their equivalents.

What is claimed is:

1. A paper feeding device, comprising:

a paper cassette in which paper sheets are stored, the paper cassette being removably mountable in a first direction to a paper feeding device, the paper cassette including a cassette casing and a tray for supporting the paper sheets thereon, the tray being supported by the cassette casing and rockable in a predetermined direction such that the paper sheets move up and down;

means for moving the tray up in said predetermined direction;

takeout means for taking out the paper sheets from the paper cassette one by one in a second direction when the tray is moved up by the moving means, the second direction being generally perpendicular to the first direction;

means for receiving the paper sheets taken out by the takeout means, the receiving means including means for preventing the receiving means from receiving an extra paper sheet when the takeout means provides the extra paper sheet; and means or controlling the moving means so that the paper sheets in the paper cassette continuously move up and down a plurality of times after the end of paper takeout operation by the takeout means to return the extra paper sheet to the tray.

2. A paper feeding device according to claim 1, wherein the paper cassette includes an opening in the bottom thereof, and the moving means includes an elevator rockably located in a position opposite to the opening of the paper cassette and capable of being inserted into and removed from the paper cassette; and an elevator operating mechanism for rocking the elevator, thereby pushing up the tray so that the paper sheets in the paper cassette reach a position suited for takeout.

3. A paper feeding device according to claim 2, wherein said elevator operating mechanism includes a rotatable shaft fitted with the elevator; a toothed rocking member mounted on the shaft; an urging member for continually urging the toothed rocking member so that the elevator gets out of the paper cassette; a drive source capable of being driven forwardly and reversely so that the elevator drives the toothed rocking member to push up and lower the tray, resisting the urging force of the urging member; and a first gear group for transmitting the driving force of the drive source to the toothed rocking member.

4. A paper feeding device according to claim 2, wherein said elevator operating mechanism includes a rotatable shaft fitted with the elevator; a toothed rocking member mounted on the shaft; an urging member for continually urging the toothed rocking member so that the elevator gets out of the paper cassette; a drive source capable of being driven forwardly and reversely so that the elevator drives the toothed rocking member to push up and lower the tray, resisting the urging force of the urging member; a first gear group for transmitting the driving force of the drive source to the toothed rocking member; a clutch mechanism for connecting and disconnecting the path of transmission of the driving force from the drive source to the tooth rocking member; and a clutch release member for releasing the clutch mechanism.

5. An image forming apparatus comprising:

image forming means for forming an image on a paper sheet; and a paper feeding device for feeding the paper sheet to the image forming means, the paper feeding device, comprising:

a paper cassette in which paper sheets are stored, the paper cassette being removably mountable in a first direction to the paper feeding device, the paper cassette including a cassette casing and a tray for supporting the paper sheets thereon, the tray being supported by the cassette casing and rockable in a predetermined direction such that the paper sheets move up and down;

means for moving the tray up in the predetermined direction;

takeout means for taking out the paper sheets from the paper cassette one by one in second direction when the tray is moved up by the moving means, the second direction being generally perpendicular to the first direction;

means for receiving the paper sheets taken out by the takeout means, the receiving means including means for preventing the receiving means from receiving an extra paper sheet when the takeout means provides the extra paper sheet; and means for controlling the moving means so that the paper sheets in the paper cassette continuously move up and down a plurality of times after the end of paper takeout operation by the takeout means to return the extra paper sheet to the tray.

6. An image forming apparatus according to claim 5, wherein the paper cassette includes an opening in the bottom thereof, and the moving means includes an elevator rockably located in a position opposite to the opening of the paper cassette and capable of being inserted into and removed from the paper cassette; and an elevator operating mechanism for rocking the elevator, thereby pushing up the tray so that the paper sheets in the paper cassette reach the position suited for takeout.

7. An image forming apparatus according to claim 6, wherein the elevator operating mechanism includes a rotatable shaft fitted with the elevator; a toothed rocking member mounted on the shaft; an urging member for continually urging the toothed rocking member so that the elevator gets out of the paper cassette; a drive source capable of being driven forwardly and reversely so that the elevator drives the toothed rocking member to push up and lower the tray, resisting the urging force of the urging member; and a first gear group for transmitting the driving force of the drive source to the toothed rocking member.

8. An image forming apparatus according to claim 6, wherein the elevator operating mechanism includes a rotatable shaft fitted with the elevator; a toothed rocking member mounted on the shaft; an urging member for continually urging the toothed rocking member so that the elevator gets out of the paper cassette; a drive source capable of being driven forwardly and reversely so that the elevator drives the toothed rocking member to push up and lower the tray, resisting the urging force of the urging member; a first gear group for transmitting the driving force of the drive source to the toothed rocking member; a clutch mechanism for connecting and disconnecting the path of transmission of the driving force from the drive source to the toothed rocking member; and a clutch release member for releasing the clutch mechanism.

* * * * *